United States Patent [19]

Durant

[11] 4,041,811

[45] Aug. 16, 1977

[54] TORQUE LIMITING DRIVER

[76] Inventor: Walter F. Durant, 664 Noank Road, Mystie, Conn. 06355

[21] Appl. No.: 684,929

[22] Filed: May 10, 1976

[51] Int. Cl.[2] ..... B25B 23/14

[52] U.S. Cl. ..... 81/52.4 R

[58] Field of Search ..... 81/52.4 R, 52.4 A; 64/30 C, 30 A, 30 R; 192/65

[56] References Cited

U.S. PATENT DOCUMENTS

| | | | |
|---|---|---|---|
| 1,238,654 | 8/1917 | Ewart | 64/30 A |
| 2,439,980 | 4/1948 | Livermont | 81/52.4 R |
| 2,933,959 | 4/1960 | McMahon | 81/52.4 R |

FOREIGN PATENT DOCUMENTS

| | | | |
|---|---|---|---|
| 328,888 | 11/1920 | Germany | 64/30 A |

*Primary Examiner*—James L. Jones, Jr.
*Attorney, Agent, or Firm*—Berman, Aisenberg & Platt

[57] ABSTRACT

A hand operated nut or screw driver which utilizes an adjustable clutch action to limit the amount of torque applicable to a workpiece. An elongated handle member has a pair of clutch hubs, one disposed at either end thereof, for frictional engagement with pre-formed recesses in the handle. Each clutch hub is fixedly engaged with a driven shaft that extends freely through the handle. The driven shaft is threadingly engaged at one end by an adjusting knob and has workpiece engaging means formed at its distal end. The torque at which the handle member slips relative to the clutch hubs is proportional to the degree to which the adjusting knob is threadingly secured on the driven shaft.

8 Claims, 4 Drawing Figures

TORQUE LIMITING DRIVER

BACKGROUND OF THE INVENTION

1. Field of the Invention

The present invention is related to a torque transmitting tool and, more particularly, is directed towards a hand-operated adjustable wrench or screw driver by means of which a predetermined torque may be applied to a workpiece such as a nut or screw.

2. Description of the Prior Art

The prior art contains many examples of devices which may be utilized to limit the amount of torque applicable to a driven workpiece, such as a screw bolt or nut. Prior art U.S. Patents of which I am aware which describe typical torque-limiting tools include: U.S. Pat. Nos. 2,732,746; 2,757,523; 2,772,589; 2,872,004; and 2,933,959.

Of the foregoing devices, several are designed to be utilized in conjunction with power-driven tools, while others are unnecessarily complicated or bulky and are therefore not amenable to the speedy and accurate tightening of small bolts, nuts and screws.

OBJECTS AND SUMMARY OF THE INVENTION

It is therefore a primary object of the present invention to provide a hand-operable tool for limiting the amount of torque applicable to a driven workpiece which is simple in construction, easy to operate, and facilitates the speedy and accurate tightening of samll bolts, nuts and screws.

A further object of the present invention is to provide a hand-operated screw driver or wrench which includes means for limiting the amount of torque transmittable to a driven screw, nut or bolt, and which is more durable than prior art devices and is easier to use in that its utilization is akin to a conventional hand-held screw driver.

An additional object of the present invention is to provide a torque-limiting driver for screws, nuts and bolts, which is comprised of a minimum number of parts, is easly assembled, easily mass produced, inexpensive to manufacture, and is readily adaptable to drive any conventional socket wrench or socket screw driver.

The foregoing and other objects are attained in accordance with one aspect of the present invention through the provision of a torque-limiting driver which comprises an elongated driven member having means for engaging a workpiece at one end thereof. An elongated handle member surrounds a substantial portion of the driven member and has a pair of clutch surfaces disposed one at either end thereof. A first and second hub member are respectively adapted to fit adjacent the clutch surfaces of the elongated hand member, and means are provided for adjusting the frictional fit between the hub members and the clutch surfaces of the handle member in order to adjust the torque limit at which the handle member begins to slip. The first hub member is fixedly secured to the elongated driven member adjacent the workpiece end thereof so as to rotate therewith, while the second hub member is also fixedly disposed about the elongated driven member adjacent its distal end.

In accordance with other aspects of the present invention, the elongated handle member includes a channel formed longitudinally therein through which the elongated driven member is non-frictionally disposed, the distal end thereof being threadingly engaged by a knob which comprises the means for adjusting the frictional fit between the hub members and clutch surfaces of the handle. The knob includes a force transmitting surface which lies adjacent and in contact with a similarly formed surface of the second hub member. In a preferred embodiment, the clutch surfaces of the handle member are each comprised of a frustoconical surface, each of the hub members having a congruent frustoconical surface for bearing against their corresponding clutch surfaces, with a force proportional to the degree to which the knob is threadingly secured to the distal end of the elongated driven member.

In accordance with still other aspects of the present invention, the second hub member may include indicia formed on the outer cylindrical periphery thereof which cooperates with an index marker formed on the outer periphery of the knob which togeter provides a calibrating means for indicating the torque limit at which the knob is set.

BRIEF DESCRIPTION OF THE DRAWINGS

Various objects, features and attendant advantages of the present invention will be more fully appreciated as the same become better understood from the following detailed description of the present invention when considered in connection with the accompanyings, in which.

DETAILED DESCRIPTION OF THE PREFERRED EMBODIMENT

Figure 1:
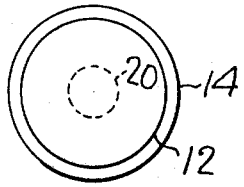
FIG. 1 illustrates a top view of a preferred embodiment of the present invention.
Figure 2:
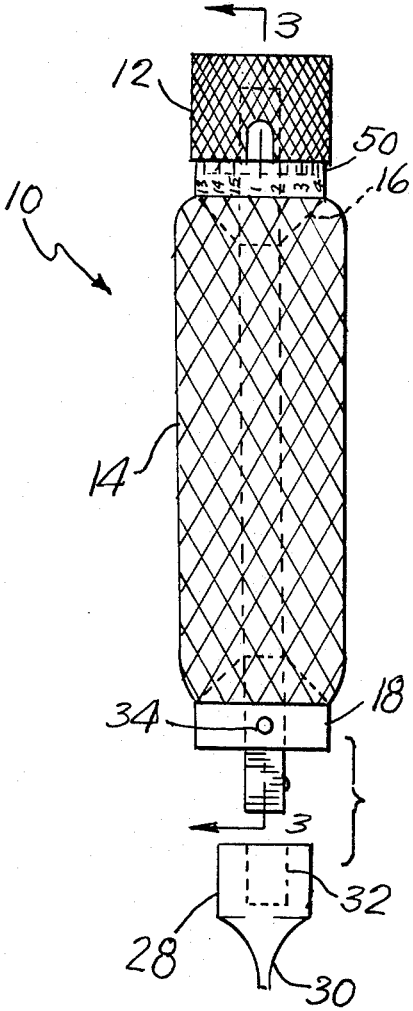
FIG. 2 is a side view of a preferred embodiment of the present invention.

Referring now to the drawings, wherein like reference numerals designated identical or corresponding parts throughout the several views, and more particularly to FIGS. 1 and 2 thereof, a top and side view respectively illustrates a preferred embodiment of the torque-driver tool of the present invention indicated generally by the reference numeral 10.

The torque-limiting driver 10 in the embodiment illustrated comprises an elongated somewhat cylindrical handle 14 whose exterior may be roughened or knurled in order to facilitate the gripping thereof. The length of handle 14 is preferably designed to facilitate hand-held operation, which may be similar to that of a conventional screw driver.

Figure 3:
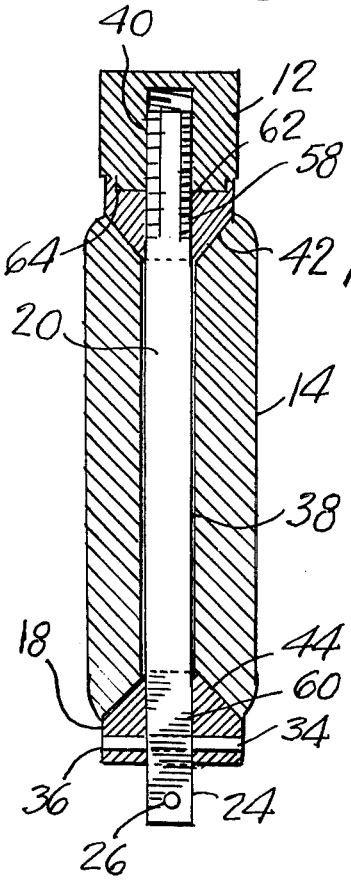
FIG. 3 is a sectional view of the preferred embodiment of the present invention illustrated in FIG. 2 and taken along line 3—3 thereof.
Figure 4:
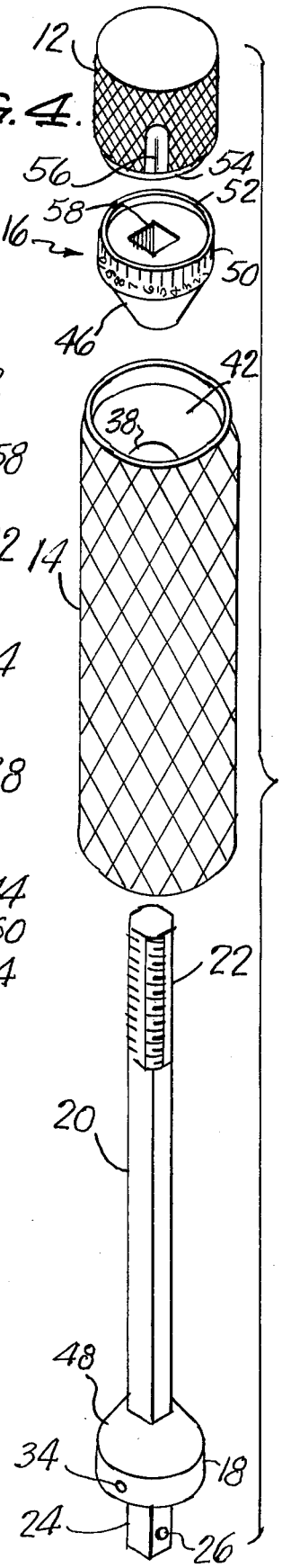
FIG. 4 is an exploded view illustrating the essential components of the preferred embodiment of the present invention in perspective.

As seen in FIG. 3, handle 14 has a longitudinal channel 38 formed therein, channel 38 being preferably circular in cross-section. Positioned within the channel 38 of handle 14 so as to be freely rotatable therein is a rod-like elongated shaft 20, preferably squared in cross-section, the upper end of which is threaded as at 22, the lower end 24 of which may accommodate any of a number of conventional socket wrench heads, such as, for example, socket screw driver 28 (FIG. 2). Socket screw driver 28 includes a conventional tapered head 30 and has a square recess 32 to fit onto the square end 24 of driven shaft 20. The square end 24 of shaft 20 also includes a conventional spring-loaded ball 26 for holding the socket wrench or screw driver 28 in place.

Handle 14 includes a pair of clutch surfaces 42 and 44 formed one at each open end thereof. Each of the clutch surfaces 42 and 44 in the preferred embodiment are shaped as inwardly tapered frusto-conical surfaces and are designed to mate with congruent surfaces of a pair of hub members, to be described in more detail hereinafter.

The torque-limiting driver 10 of the present invention further includes a pair of clutch hub members 16 and 18. The lower clutch hub member 18 includes a frusto-conical tapered surface 48 which is designed so as to provide a good friction fit with frusto-conical surface 44 of handle 14. Clutch hub 18 further has a square channel 60 formed along its axis for receiving the squared end 24 of shaft 20. Another aperture 36 may be formed transversely to aperture 60 for accommodating a retaining pin 34 secured through a similarly-sized aperture in the squared end 24 of shaft 20, so as to ensure the rotational movement of clutch hub 18 along with that of shaft 20. Clutch hub 18 may alternatively be welded to shaft 20, or the members 18 and 20 could be cast as a unitary piece.

The upper clutch hub 16 includes a square aperture 58 formed axially therein for accommodating the upper squared portion of shaft 20 so as to be rotatable therewith. A frusto-conical tapered surface 46 of clutch hub 16 is designed to provide a close frictional fit with the congruent clutch surface 42 of handle 14, as perhaps best viewed in FIG. 3.

The preferred embodiment of the torque-limiting driver 10 of the present invention finally includes a substantially cylindrical adjusting knob 12 wich is internally threaded at 40 for engagement with the threads 22 of shaft 20. The exterior surface of knob 12 may also be roughened or knurled in order to facilitate the gripping thereof. A reduced diameter extension 54 of knob 12 is receivably engaged within an upwardly extending lip 52 of clutch hub 16 for close fitting engagement of the force transmitting surfaces 62 and 64 thereof.

The external periphery of knob 12 is also provided with an index marker 56 which, together with the indicia or graduations 50 provided on the outer visible periphery of clutch hub 16, indicates the degree to which knob 12 is threadingly secured on the threaded end 22 of shaft 20.

In operation, the indicia 50 and marker 56 on hub 16 and knob 12 may be pre-calibrated in order to provide a direct reading indication of a preset torque limit to be applied to the particular workpiece. The turning of knob 12 to the desired setting with respect to hub 16 causes a predeterminable force to be applied via hub 16 between the inclined adjacent surfaces 46 and 42, and the adjacent surfaces 44 and 48 of the clutch hubs 16 and 18 respectively, and handle member 14. Manual rotation of the handle member 14 will proceed to rotate the workpiece engaged by driver 28 attached to end 24 of shaft 20 until the set torque is attained, at which time slippage will occur between the friction-fit surfaces 42 and 46, and 44 and 48, of the handle member 14 and clutch members 16 and 18.

It should be apparent from the foregoing that in order to increase the amout of torque applicable to a particular workpiece, knob 12 may be further tightened onto threaded end 22 of shaft 20, while to reduce the torque limit, knob 12 may be unscrewed or rotated counterclockwise with respect of shaft 20.

Obviously, numerous variations and modifications of the present invention are possible in light of the above teachings. It is therefore to be understood that within the scope of the appended claims, the invention may be practiced otherwise then as specifically described herein.

I claim as my invention:

1. A torque-limiting driver, which comprises:

an elongated driven member having means for engaging a workpiece disposed at one end thereof and which is threaded at the other end thereof;

an elongated handle member movably disposed about said driven member and having a pair of clutch surfaces integrally formed one at each end thereof;

a first hub member axially and rotatingly secured to said elongaged driven member at said one end thereof adjacent one of said clutch surfaces of said handle member;

a second hub member rotatingly secured to said elongaged driven member but axially movable therealong adjacent the other of said pair of clutch surfaces; and knob means threadingly secured to said other end of said elongated driven member adjacent said second hub member for permitting adjustment of the frictional fit between each of said hub members and their respective, adjacent clutch surfaces of said handle member.

2. The torque-limiting driver as set forth in claim 1, wherein said elongated driven member is non-circular in cross-section, and wherein said second hub member has an axial channel which is congruent in cross-section to that of said elongated driven member so as to be rotatable therewith and axially moveable therealong.

3. The torque-limiting driver as set forth in claim 2, wherein said handle member includes an aperture axially formed therein and of a diameter sufficient to enable said elongated driven member to rotate freely therewithin.

4. The torque-limiting driver as set forth in claim 1 wherein said knob means includes a force transmitting surface disposed adjacent said second hub member.

5. The torque-limiting driver as set forth in claim 4 wherein said pair of clutch surfaces of said elongated handle member each are comprised of a frusto-conical surface.

6. The torque-limiting driver as set forth in claim 5 wherein said first and second hub members each include a frustoconical surface adapted to bear against the adjacent frustoconical surface of said elongated handle member with a force proportional to the degree to which said knob means is threadingly secured to said other end of said elongated driven member.

7. The torque-limiting driver as set forth in claim 6 wherein said second hub member includes indicia means formed on the outer periphery thereof, and wherein said knob means includes an index marker on its outer surface which, in conjunction with said indicia means, provides an indication as to the limit of torque applicable to said workpiece.

8. The torque-limiting driver as set forth in claim 7 wherein said second hub member includes a planar surface disposed in contact with said force transmitting surface of said knob means.

* * * * *